US010239716B2

(12) United States Patent
Abergel

(10) Patent No.: US 10,239,716 B2
(45) Date of Patent: Mar. 26, 2019

(54) DEVICE AND METHOD FOR TRANSPORTING SUBSTRATES IN A PRINTING MACHINE

(71) Applicant: MGI DIGITAL TECHNOLOGY, Fresnes (FR)

(72) Inventor: Edmond Abergel, Paris (FR)

(73) Assignee: MGI Digital Technology, Fresnes (FR)

( * ) Notice: Subject to any disclaimer, the term of this patent is extended or adjusted under 35 U.S.C. 154(b) by 0 days.

(21) Appl. No.: 15/516,817

(22) PCT Filed: Oct. 5, 2015

(86) PCT No.: PCT/EP2015/072932
§ 371 (c)(1),
(2) Date: Apr. 4, 2017

(87) PCT Pub. No.: WO2016/055411
PCT Pub. Date: Apr. 14, 2016

(65) Prior Publication Data

US 2017/0291436 A1 Oct. 12, 2017

(30) Foreign Application Priority Data

Oct. 8, 2014 (EP) ..... 14290304

(51) Int. Cl.
*B65H 5/08* (2006.01)
*B41J 11/00* (2006.01)
(Continued)

(52) U.S. Cl.
CPC ..... *B65H 5/08* (2013.01); *B41J 11/0045* (2013.01); *B41J 11/0085* (2013.01); *B41J 13/22* (2013.01); *B41J 15/165* (2013.01); *B65H 5/085* (2013.01); *B65H 29/02* (2013.01); *B65H 29/52* (2013.01); *B65H 85/00* (2013.01); *B65H 2301/44338* (2013.01); *B65H 2301/5124* (2013.01); *B65H 2404/74* (2013.01); *B65H 2406/312* (2013.01); *B65H 2406/351* (2013.01); *B65H 2555/13* (2013.01); *B65H 2701/11312* (2013.01); *B65H 2801/15* (2013.01)

(58) Field of Classification Search
CPC . B65H 5/04; B65H 5/08; B65H 5/085; B65H 2301/44336; B65H 2301/44338; B65H 2301/4472; B41J 11/0085
See application file for complete search history.

(56) References Cited

U.S. PATENT DOCUMENTS

2011/0157288 A1 6/2011 Toshiyasu et al.
2013/0050376 A1 2/2013 Hiroaki
(Continued)

FOREIGN PATENT DOCUMENTS

DE 19901698 A1 8/1999
DE 102012103533 A1 10/2013
(Continued)

*Primary Examiner* — Michael C McCullough
(74) *Attorney, Agent, or Firm* — Maschoff Brennan

(57) ABSTRACT

The object of the present invention is to propose a novel device and a novel method to allow the transportation of printable substrates precisely, suited to substrates of various types, sizes and thicknesses. Furthermore, the invention is suited to printing machines that involve no contact with the substrate, such as inkjet printing machines.

19 Claims, 3 Drawing Sheets

(51) Int. Cl.

| | |
|---|---|
| ***B41J 13/22*** | (2006.01) |
| ***B65H 29/02*** | (2006.01) |
| ***B65H 29/52*** | (2006.01) |
| ***B65H 85/00*** | (2006.01) |
| ***B41J 15/16*** | (2006.01) |

(56) References Cited

U.S. PATENT DOCUMENTS

| | | | | |
|---|---|---|---|---|
| 2015/0049150 | A1 | 2/2015 | Muench et al. | |
| 2015/0137446 | A1* | 5/2015 | Carlson ..... | B65H 3/0816 271/275 |

FOREIGN PATENT DOCUMENTS

| | | | |
|---|---|---|---|
| EP | 2226198 | A1 | 9/2010 |
| EP | 2292438 | A1 | 3/2011 |
| JP | H05301401 | A | 11/1993 |
| WO | 2013156540 | A1 | 10/2013 |

* cited by examiner

DEVICE AND METHOD FOR TRANSPORTING SUBSTRATES IN A PRINTING MACHINE

FIELD OF THE INVENTION

The present invention relates to the field of printing, in particular without contact with the substrates, and more particularly to a device and method for transporting printable and printed substrates to all the workstations included in a printing machine, the transport of the substrates being carried out so as to enable their printing in optimal conditions.

BACKGROUND

Transport of printable substrates formed by suction belts is known from the prior art, the function of which is to hold and keep a substrate against said belts as they move. This type of solution, well known to those skilled in the art, has a few disadvantages however. In particular, this type of device, causing movements of air and pressure gradients, can cause deformation of substrates if the latter are large in size. The accuracy of the printing will therefore be affected. On the other hand, the use of these suction belts with some wide used printing technologies, especially inkjet printing, can cause accidental aspiration of ink present in the printing heads and cause the deactivation of the printing heads. In the best of cases this type of incident needs reactivating of the heads, and in the worst of cases replacement of the deactivated heads, the latter now unusable.

To overcome these problems, especially to allow moving of substrates precisely, there are in the prior art techniques using cylinders comprising a plurality of clamps gripping the substrates by the front edge relative to the direction of moving of the substrate. Adapted to printing machines of inkjet type, this type of solution has several disadvantages however. Indeed, this system needs all the heads inkjet to be arranged orbitally around a large-sized cylinder. Moreover, this type of system poses the problem of the difficulty in adjusting the position of the printing heads. In fact, for quality printing, ink ejected from the printing heads must form a jet whereof the direction is perpendicular to the surface of the substrate. It is understood in this case that the use of a cylinder to transport and hold the substrate, whereof the surface by definition is not flat, means intricate adjusting of the position of the printing heads. For this same reason, it is difficult to use substrates of variable thickness, as the change of substrate means adjusting all the printing heads. On the other hand, the printing pitch, that is, the position of the clamps on the cylinder, is fixed, meaning that the printing rate remains the same regardless of the size of the substrate.

Also known from the prior art are substrate transport systems using chains or conveyors on which clamps are arranged to grip the substrates and transport them on a transport path whereof a portion is flat, resolving the problem of arrangement of the printing heads. However, this type of solution always has the problem of fixed printing pitch, which imposes a fixed rate and in this case poses the extra problem of not being able to use substrates of different sizes without stopping printing and proceeding with intricate adjusting of the position of the clamps.

More recently, the Applicant has proposed in its patent application WO2013156540 a device and method for transporting printable substrates precisely, adapted to substrates of various types, sizes and thicknesses, and to make prints at variable pitch. There is described a substrate transport system in a printing machine, along a transport path oriented according to a longitudinal axis from at least one entry store supplying the printable substrates to at least one exit store receiving the substrates, characterized in that it comprises mobile gripping means, each comprising an opening/closing system ensuring release or gripping of a substrate, said gripping means comprising front and rear gripping means, each gripping a part of the substrate, respectively front and rear of the same substrate, along the transport path, guide means for guiding the gripping means along the transport path, at least one motorisation means ensuring moving of the gripping means along guide means, preferably with independent moving between at least the front gripping means and the rear gripping means, the substrate transport system being adapted to grip each substrate so as to tense and/or move substrates, even if they have variable lengths, along the transport path, the guide means, the gripping means and their associated opening/closing system being controlled by computer facilities.

Although the device and method of WO2013156540 already meet a highly satisfactory manner the needs of the man skilled in the art, the Applicant has now developed a device and method that improve the transport of printable substrates on all workstations included in a printing machine, in particular a printing machine without contact with the substrate, such as inkjet printing machines.

Patent application US2015/0049150 discloses an apparatus for conveying a substrate, wherein the apparatus comprises rails and mobile units moving and maintaining the substrate that are configured to interact so that the moving of the mobile units is effected by magnetic interaction between the rail and said mobile units. The use of a low pressure rest (70), sometimes also referred to as a vacuum rest, is disclosed in the embodiments described in FIGS. 5 and 6.

SUMMARY

The present invention proposes a novel device and a novel method for transporting printable and printed substrates precisely, adapted to substrates of various types, sizes and thicknesses. In particular, the invention makes it possible to produce printing at variable pitch. Also, the invention is adapted to printing machines without contact with the substrate, such as inkjet printing machines.

For this purpose, the invention relates to a substrate transport system in a printing machine, along a transport path from at least one entry store supplying printable substrates to at least one exit store receiving the substrates, comprising:

1. an entry store for storing the printable substrate,
2. an optional transport system for the substrate from the entry store to the suction table,
3. a fixed suction table for maintaining the substrates flat on said table,
4. a mobile gripping means gripping a front part of the substrate along the transport path,
5. a guide means for guiding the gripping means along the transport path,
6. a motorisation means ensuring moving of the gripping means along the guide means,
7. an optional transport system for the printed substrate from the suction table to the exit store,
8. an exit store for storing the printed substrate, whereby the substrate transport system is adapted to move each substrate so as to move it on the fixed suction table along the transport path and characterised in that the transverse dimension of the suction table is at least equivalent to the transverse dimension of the substrate.

Other features and advantages of the substrate transport system are detailed in the present application. An additional object of the invention is to provide a method for transporting printable substrates.

For this purpose, the invention relates to a method for transport of substrates along a transport path, executed by the substrate transport system according to the invention, characterised in that it comprises the following steps:

a) storing the printable substrate in an entry store,
b) moving and maintaining the substrate flat on a fixed suction table having a transverse dimension at least equivalent to the transverse dimension of the substrate,
c) positioning of the gripping means by said motorisation means in an area near the entry store,
d) following detection of the front transversal edge of the substrate relative to the direction of moving, gripping by the gripping means of at least an edge of the substrate near the front part of said substrate, said gripping means dragging the substrate on the fixed suction table through the printing station,
e) releasing by the substrate gripping means when the position of the said substrate is in an area near the exit store of the printing machine,
f) storing of the printed substrate in the exit store,
g) return of the gripping means in an area near the entry store.

Other particular features and advantages of the method for transport of substrates are detailed in the present application.

BRIEF DESCRIPTION OF THE DRAWINGS

The invention, with its characteristics and advantages, will emerge more clearly from the description given in reference to the appended drawings, in which.

DETAILED DESCRIPTION

Figure 1:
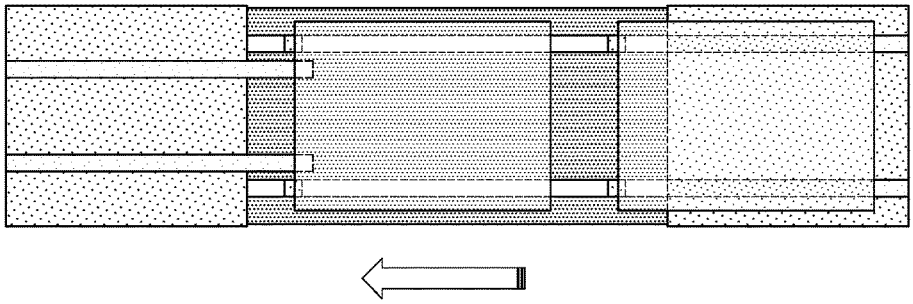
FIGS. 1 and 2 schematically illustrate a first embodiment of the invention.

The present invention has many advantages over the techniques of the prior art and, in particular, compared to WO2013156540 and US2015/0049150. For example, we can cite the possibility of tensioning the substrate by the combined action of moving the mobile gripping means with flattening and maintaining of the entire transverse dimension of the substrate by the suction table (during printing of the substrate and, optionally, also during drying and/or curing of the ink on the substrate); this allows not only to minimise the number of mobile gripping means but also to minimise the number of motors necessary for the moving of the gripping means. Moreover, the present invention allows to start printing at a distance near the gripping by the movable gripping means of the front part of the substrate along the transport path, which makes it possible to bring the printing device closer to the entry store; therefore, the length of the transport path and also the dimension of the printing system are substantially reduced. Additional advantages brought by the present invention will be further demonstrated in the description and figures.

The present invention relates to a substrate transport system or device, and to a method for transport of substrates. The substrate transport system is described below with reference to the figures, but it is clear that the figures and examples provided in the present application are illustrative and not limitative. Said substrate transport system is comprised in a printing machine, for example and in a non-limiting way an inkjet printing machine.

In a preferred embodiment of the present invention, the substrate transport system in a printing machine is carried along a transport path which is oriented according to a longitudinal axis from the entry store supplying the printable substrates to the exit store receiving the printed substrates. In an alternative operating mode transverse orientations of certain parts of the transport path can be organised (for example for the first move of the printable substrate from the entry store to the next part of the transport path and/or for the last move of the printed substrate to the exit store).

In a preferred embodiment of the present invention, the transport system (and thus the printing machine) is controlled by computer facilities which control in particular the various workstations and also collect the information from different sensors. These computer facilities don't have to be described in detail in the present application and they may, for example, be integrated into the machine or remote in a separate device. The sensors give, for example, information of positions of substrates, information of configurations of substrates and/or information on validation following an operation completed correctly or not. Some information necessary for executing the invention can also be loaded previously in the computer facilities (for example via input on an interface by an operator). Such information can for example relate to the size of the substrates or their thickness, but it is generally preferred that sensors measure or verify such information. The substrates waiting for printing are generally, as known per se, placed in at least one entry store having a capacity defined as a function of the nature of the substrate and printing requirements. In one embodiment, an entry store is provided to accept several tens, hundreds or even thousands of substrates variable in nature, thickness and dimension (for example, and in a non-limiting way, a format having sides of the order of one centimeter, for example a typical format A10, for example a credit card format; up to a format whose sides are of the order of several meters, for example an A0 type format or a 2×2 meters format). Once the printing method is over, the substrates are stored in at least one exit store generally having the same capacity as an entry store.

A characteristic of the present invention is therefore the use of a fixed suction table for maintaining the substrates flat on said table along the transport path and more particularly under the printing station. The suction tables and their operation are well known to the man skilled in the art and it will thus be readily possible for the latter to use a suction table suitable for the present invention. The constitution and the dimensions of the suction table are not critical as long as it fulfils its role of maintaining flat the entire substrate while allowing its move by the action of the mobile gripping means. Thus, according to a particular embodiment of the present invention, the tensile force exerted by the mobile gripping means to move the substrate is at least greater than the force for maintaining in position said substrate on the fixed suction table. In order to meet the particular objectives of the present invention, the dimensions of the suction table will preferably correspond to the following criteria: a transverse dimension (i.e. perpendicular to the longitudinal axis in the plane of the transport path) at least equivalent to the transverse dimension of the largest substrate used—and a longitudinal dimension at least equivalent to the longitudinal dimension represented by the printing station as such. This minimal longitudinal dimension is justified by the fact that the substrate is well maintained flat and under a tension sufficient to ensure an optimum printing when it is moved by the mobile gripping means under the printing station. According to a particular embodiment of the present invention, a station for curing and/or drying the ink deposited on the substrate is present in the printing machine and is located after the printing station; this curing and/or drying station advantageously comprises an ultraviolet radiation system, for example UV radiation with a conventional UV lamp, and/or UV radiation by light-emitting diode (LED), preferably UV radiation comprising a light-emitting diode (LED) station and a conventional UV lamp station. According to a particular embodiment of the present invention, when a curing and/or drying station for the ink of the printed substrate is located after the printing station, a transport system consistent with the one used in the printing station is used, namely a fixed suction table and at least one mobile gripping means. The suction table will therefore have a longitudinal dimension sufficient to transport flat the printed substrate through said curing and/or drying station and preferably has a transverse dimension at least equivalent to the transverse size of the printed substrate. One or two (or more) suction tables in series may therefore be used according to the present invention. In a particular and preferred configuration according to the present invention, the fixed suction table will be the same for the printing station as well as the drying and/or curing station; in this configuration, the suction table will therefore have a longitudinal dimension sufficient to transport flat the substrate from the entry of the printing station to the exit of the drying and/or curing station. In a particular and preferred configuration according to the present invention, the same mobile gripping means will be used both for transporting the substrate through the printing station and through the drying and/or curing station. The Applicant has surprisingly found that the use of the fixed suction table for maintaining the substrate flat during its transport through the drying and/or curing station could improve said drying and/or curing. Thus, in this particular configuration, the ink (preferably a varnish) will preferably be of the "curable ink" and/or "curable varnish" type; by way of illustration, mention will be made of varnishes and/or inks comprising, in their composition, at least one component containing a polymerisable functionality, preferably an acrylate function.

The fixed suction table is generally made mainly of metal. A characteristic of the suction table according to the present invention is that it allows the substrate to be moved while maintaining the substrate flat; thus, the fixed suction table consists of, at least in its upper layer coming into contact with the substrate, a material which satisfies the requirements related to this characteristic. According to a particular embodiment of the present invention, the fixed suction table comprises, at least in its upper layer coming into contact with the substrate, a material allowing the substrate to slide on the table. Non-limiting examples of said sliding material are thermoplastic polymers, for example polytetrafluoroethylene, also known as Teflon, or a grained metal surface. According to another particular embodiment of the present invention, the surface of the suction table on which the substrate is moved along the transport path induces a friction force generating tensioning of the substrate when moved. This fiction force causing the tensioning may, for example, come from the chemical nature of the surface of the table which is in contact with the substrate. Any other suitable means for responding to this frictional force characteristic may also be used in the present invention; by way of non-limiting example, mention will be made of the roughness of the surface of the table which is in contact with the substrate. This roughness can either come from the very nature of the upper layer of the table, or may result from any chemical and/or physical treatment of said upper layer of the table, for example by an abrasion technique. This characteristic makes it possible to obtain, during moving of the substrate by the mobile gripping means, a tensioning of the said substrate sufficient to allow an optimal positioning of the said substrate during printing. According to a particular embodiment of the present invention, the fixed suction table comprises several suction zones (for example different zones connected to different chambers) in order to control the suction power of the table as a function of the positioning of the substrate; this not only optimises balancing of the suction regardless of the position and dimension of the substrate, but also limits suction in specific areas like below the print heads.

A feature of the present invention is therefore the use of at least one mobile gripping means gripping a front part of the substrate along the transport path; by way of example of the front part of the printable substrate, mention will be made of the two front corners of the substrate, the front edge of the substrate and/or the two side edges of the substrate close to the front edge of the substrate. The mobile gripping means may advantageously comprise an opening/closing system ensuring the release or gripping of a substrate, by way of example one or more clamps as described further in the present description. It will be apparent to the man skilled in the art that other mobile gripping systems could also be used within the scope of the present invention. By way of non-limiting example, mention will be made of a mobile transverse strip which will allow the substrate to move along the transport path by pinching the substrate under the action of pressure between the said strip and the fixed table.

According to a particular embodiment of the present invention, the vertical dimensions (i.e. perpendicular to the plane of the transport path) of the mobile gripping means situated above the substrate will be minimized. In order to ensure optimum printing of the substrate, it is preferable to minimize the distance separating the upper surface of the substrate from the print heads. Since this optimum distance is generally less than 5 millimeters (mm) and may even be in the order of a millimeter (mm), it will thus be preferred to use a system of mobile gripping means whose vertical dimensions will be less than the distance between the upper face of the substrate and the print heads, for example less than 80% of the distance (perpendicular to the substrate) between the upper face of the substrate and the print heads, for example less than 4 mm, 3 mm, 2 mm, and even less than or equal to 1 mm.

According to a particular embodiment of the present invention, the suction table comprises one or more longitudinal recesses so that the gripping means can be suitably housed therein. In a preferred embodiment, the assembly of the gripping means is housed in the longitudinal recess(es) of the suction table, which makes it possible to minimize their vertical dimensions, or even make them null or even negative (for example in the case where the gripping means would be located beneath the substrate). These recesses may be of any suitable type. By way of illustration, and as described further in the description, one or more rails passing through the table may be used:

configuration A: a single longitudinal rail located in the middle of the suction table and of equivalent or greater length than the suction table, which is equivalent to a device comprising two identical suction tables separated centrally by the system of the mobile gripping means;

configuration B: two longitudinal rails of equivalent or greater length to the suction table and located respectively near the left side of the suction table and the other near the right side of the suction table, which is equivalent to a device comprising three separate parts of suction tables separated by the two systems of mobile gripping means;

configuration C: configurations similar to configurations A or B with a rail length lower than that of the table.

In a particular embodiment of the present invention, a device for gripping the substrates (for example, one or more suction belts) allows the substrates to be taken out of the entry store and places them on drive means, for example the transport system of substrates whereof the characteristics will be detailed later in the description, to move them along a work chain generally comprising several workstations, for example and in a non-limiting way at least one printing station comprising a plurality of ink (and/or varnishes) jet printing heads preferably controlled by the computer facilities, followed optionally and preferably by a curing and/or drying station of the ink (preferably of the varnish), which ink and/or varnish being of any suitable type; by way of illustration, mention will be made of functional and/or intelligent inks, etc. In general, checks are also made to detect the presence of a substrate at each station of the conveyor. The printing machine can perform printing from one substrate to the other with variable pitch, using the transport system as detailed herein below. This means that the printing machine is capable of adapting use of the printing heads and the transport speed of the substrates as a function of the size of the substrates, for example by way of sensors installed on the printing machine. In some embodiments, the printing machine is equipped with a device for turning over the substrates, allowing recto-verso printing of said substrates.

In some embodiments, and in illustrative and non-limiting reference to the figures, the substrate transport system comprises mobile gripping means, moving along a transport path oriented according to a longitudinal axis, for example between an entry store supplying printable substrates and an exit store receiving the printed substrates. The transport path is defined by the plane in which the substrates move and oriented according to the longitudinal axis. For example, and without implying any limitation, the substrates can be blank, or comprise already printed patterns, or even be unprinted laminated, or complexed, and the like. In some embodiments, these gripping means are clamps 2, a term to be used throughout the description illustratively and non-limiting to designate the gripping means in general; these clamps 2 are described in FIGS. 1 and 2. Other gripping means such as mobile transverse strips 6, 7 are described by way of illustration in FIGS. 3 to 5. Each clamp preferably comprises an opening/closing system for gripping or releasing the substrates in convoy along the transport path (or print path). This opening/closing system is preferably controlled by the computer facilities. Each clamp generally comprises a fixed part and a mobile part, or two mobile parts, movement of which grips or releases a substrate. In the present description, the substrates, the clamps or the edges of substrates which are located towards the exit store are designated by the term "front", whereas those located towards the entry store are designated by the term "rear", in reference to the direction of movement of the substrates in the printing machine. On the other hand, the term "lateral" means the elements located on either side of the longitudinal axis of the transport path. Finally, the term "inserted" designates the clamps gripping a substrate at a level located between the front and the rear of this substrate (therefore between the front and rear clamps). It is understood that these designations are conventional and are not limiting. In some embodiments, the clamps controlled by the computer facilities grip each substrate in an area near the four corners of the substrate. But, according to the configuration (especially control made by the computer facilities), various clamps can grip the substrates in different places, especially on the front and/or rear edges and/or on the lateral edges. In some embodiments, the mobile part of each clamp is located opposite the recto of each substrate, the recto being the printable face of the substrates located opposite the printing heads. These embodiments in general facilitate release of substrates, especially when the clamps move away from the substrate in the direction of the verso face when they have released the substrate (for example in the case of a conveyor in closed circuit). In other generally preferred embodiments the mobile part of the clamps is located opposite the verso of each substrate in convoy. This arrangement limits the risks of contact of the mobile part with the printing heads. On the other hand, the position of the printing heads is generally adjustable at least in the direction of the height (perpendicularly to the plane of the transport path), avoiding any contact between the mobile part of the clamps and the printing heads. Finally, the opening/closing system of the clamps is for example controlled by an electromagnet, or a rail system. As already indicated above, a feature of the present invention is therefore the use of at least one mobile gripping means gripping a front part of the substrate along the transport path (by front part of the printable substrate, mention will be made of the two front corners of the substrate, the front edge of the substrate and/or the two side edges of the substrate close to the front edge of the substrate). Although it is also possible to use additional mobile gripping means on the lateral edges and/or the rear edge of the substrate, the present invention makes it possible by the combined action of the mobile gripping means gripping a front part of the substrate and the suction table, to be free from these additional mobile gripping means, which constitutes a considerable advantage over the prior art.

In some embodiments, the substrate transport system comprises guide means of clamps, arranged over the entire length of the transport path of the substrates. Incorrect language can designate such guide means under the term of displacement means of motorised clamps, but here the designation of guiding is preferred, especially because the clamps can comprise motorisation or only a passive part of motorisation. For example and in a non-limiting way, these guide means of the clamps are guides, rails or runners, arranged along the transport path of the substrates. In some embodiments, the guide means form a closed circuit whereof a "going" part forms the transport path and a "return" part forms a return path of the clamps towards the entry store. The term "guide" is used in the present description to designate the guide means illustratively and non-limiting. In some embodiments each displacement guide forms a closed circuit which can be for example an oblong shape, each guide being in a plane parallel to the plane of the substrates (i.e., of the transport path). In alternative embodiments, each guide is in a plane perpendicular to the plane of the substrates.

In some preferred embodiments, the transport system of the substrates comprises two guides comprising a plurality of clamps, each guide being arranged on either side of the transport path of the substrates. In some of these embodiments, the substrate transport system can comprise a plurality of guides arranged in pairs, on either side of the transport path, the distance between the guides of each pair being different to enable adaptation of the substrate transport system to substrates of different size, in particular variable width. In some preferred embodiments, the substrate transport system comprises two guides arranged on either side of the transport path of the substrates, whereof the transversal difference is variable and controlled by the computer facilities, the substrate transport system being able to adapt to any size of substrate.

In some embodiments, the transport system of substrates comprises detection means of the speed and/or of the position of the clamps along the transport path, said detection means being controlled by the computer facilities of the printing machine. For example and in a non-limiting way, each clamp can comprise a position sensor and/or a speed sensor connected to the computer facilities. In preferred embodiments, said speed and/or position sensors are integrated into the motorisation means, said motorisation means being controlled by the computer facilities, and allowing the clamps to move along the guides, in turn arranged along the transport path.

In some embodiments, the transport system for substrates comprises detection means of the front transverse edge of the substrate, for example detection means of the speed and/or of the position of the substrates when the latter enter the transport path, for example as soon as they exit from the entry store. These detection means, controlled by the computer facilities, are for example and in a non-limiting way sensors comprised in at least one entry store. For example and in a non-limiting way, this sensor is an optical coder or an optical ruler. The substrate transport system is therefore adapted in some embodiments to detect the front transversal edge of the substrate, for example thanks to detection means of the speed and/or position of substrates and allow the clamps moving along the guides, to grip each substrate so as to move it along the transport path oriented according to the longitudinal axis.

In some embodiments, the substrate transport system is also configured to tension the substrates, the tension force being applied by the combined action of the clamps and of the suction table so as to facilitate their transport and heighten printing precision. For example and in a non-limiting way, the clamps comprise a device for applying transversal tension in a controlled manner (i.e. perpendicularly to the longitudinal axis of the transport path) to the substrate, for example at the level of the opening/closing system to apply tension during closing of the clamps. Such a device for transversal tensioning can for example and in a non-limiting way comprise suction skates moving away transversally just before the closing of said clamps on the substrate. The tension applied is parameterised by means of the computer facilities as a function of the elasticity of the substrate and its width. In some embodiments non-exclusive to those with transversal tension hereinabove, longitudinal tension (that is, parallel to the longitudinal axis of the transport path) is applied to the substrate, as detailed herein below.

In an embodiment, the transport system for substrates comprises at least one guide on which is installed a plurality of gripping means and at least one motorisation means for moving the gripping means (or clamps). In some embodiments, displacement of the clamps is controlled by pairs, each of the clamps of each pair being generally arranged at the same level along the longitudinal axis (since the substrates are generally rectangular). In some of these embodiments, the clamps are independent but their displacement is synchronised per pair. In other embodiments, each clamp is connected to the other clamp of the pair located on the other side of the longitudinal axis of the transport path of the substrates. Preferably, the substrate transport system is adapted to grip each substrate so as to hold and/or move substrates of variable sizes along the transport path by the combined action of the mobile gripping means and the fixed suction table. According to a non-preferred mode, the transport system comprises at least one motorisation means ensuring displacement of the gripping means along the guide means, with independent displacement between at least the front gripping means and the rear gripping means; so, by controlling the speed of the front and rear clamps, it is possible to tense the substrates irrespective of their sizes (in length in this case, the tension in width being managed by the transversal tension device). In a preferred embodiment, the transport system comprises a single motorisation means ensuring displacement of the sole front gripping means along the guide means.

In some embodiments, said at least one motorisation means comprises motor means equipping the gripping means. A motor can for example equip the clamps, individually or per pair, to move the clamps along the guide means. So, in some of these embodiments, each gripping means comprises at least one motor means ensuring its displacement along the guide means.

In some embodiments, said at least one motorisation means comprises at least one passive part equipping the gripping means and at least one active part equipping the guide means. In such embodiments, the passive part integrated into the clamps enables displacement of the latter, for example controlled individually or in pairs, on the guide means which comprise the active part or, optionally, which are parallel to the active part. In fact, in some of these embodiments, said active part of the motorisation means comprises at least one linear motor. Also, in some of these embodiments, said at least one linear motor is installed on at least one rail parallel to the guide means. On the other hand, in some embodiments, the transport system comprises at least two guide means on which the gripping means move. In this way, it is possible to have several motorisation means (e.g., linear motors) on the guides. Finally, as explained previously, the clamps are preferably controlled in pairs (for better gripping and/or tension of substrates). In this way, in some embodiments, the transport system comprises pairs of gripping means, each comprising two gripping means located on the same side, front or rear, of the same substrate, with displacement of a pair of gripping means being ensured by the same motorisation means, along at least one guide means.

In some embodiments, the substrate transport system comprises one motorisation means per clamp. For example and in a non-limiting way, motorisation of the clamps is effected by linear motors. In embodiments, two clamps, whereof the coordinates along the longitudinal axis are substantially the same, and which are installed on guides located on either side of the transport path, are connected to the same linear motor. It is evident, so as not to subject the substrates to shearing forces which could cause their deformation or their tearing, that the speed of the clamps gripping the same substrate is synchronised.

In some embodiments, the linear motors are installed on at least one rail parallel to the guides on which are installed the clamps. In some embodiments, the linear motors are integrated into the guides. For example and in a non-limiting way, only the passive part of the linear motorisation is associated with at least one clamp, the active part being installed on each guide or on a rail parallel to the guides, according to the embodiments.

In some embodiments, the suction table is adjustable in position along an axis perpendicular to the substrate so as to optimize the distance of the substrate from the print heads of the printing machine. In some embodiments, the suction table has a profile slightly incurved so as to accentuate the longitudinal tensioning of the substrates in convoy. In some embodiments, in order to adapt to the different substrate widths used, the suction table is adjustable transversally.

In some preferred embodiments, the computer facilities, for example comprised in the printing machine, control opening and closing of the gripping means (for example clamps or transverse strips), evaluate the speed and/or position of the mobile elements, and finally deliver the command and control signals of the motorisation means (for example the linear motor or the linear motors).

Another aim of the invention is to propose a method for tensioning and transport of substrates along a transport path, executed by various embodiments of the substrate transport system described previously. The different successive steps characterising this method and its possible variants as per various embodiments will now be described, in reference to FIGS. 1 to 5 by way of illustration and non-limiting.

First, note that the printable substrate passes successively through all stations constituting the printing machine, from the entry store 10 to receipt of substrates in the exit store 12, and that the machine comprises only one printing station 18, preferably with a drying and/or curing station 16 [the said station may comprise one or more drying and/or curing systems; by way of illustration, mention will be made of UV radiation (UV and/or LED lamps), infra-red, and/or near Infra-Red, electron beam, photonic annealing, and/or two or more of these systems in combination], or several printing or personalisation stations known per se. In general, the computer facilities 14 control the opening and closing of the gripping means 2, evaluate the speed of displacement of the mobile elements, and deliver the command and control signals of the motorisation means (for example the linear motors).

It is evident that in the case of linear motors, the speeds and/or position of the gripping means 2 (for example clamps or transverse strips) are generally known due to the fact that the latter which are passive only are controlled actively. It is possible to do away with detection means 20 of gripping means 2, even though it is generally preferred to add them to ensure proper operation of the system and avoid damaging the elements of the system.

In some embodiments, the method is characterized in that it comprises the following steps:

a. positioning in an area near the entry store, by said at least one motorisation means actuated by the computer facilities 14, of at least one first gripping means 2, called front gripping means, b. following detection of the front transversal edge of a substrate relative to the direction of displacement, displacement of the front gripping means 2, at a speed adapted to that of the substrate, and positioning of said gripping means in an area near the front part of the substrate, the computer facilities 14 executing information on speed and position of the substrate to control the speeds and synchronisation of the gripping means 2 as a function of the position of the substrates along the transport path, c. closing of the front gripping means 2 by the opening/closing system on at least one edge of the substrate, said gripping means 2 from now on driving the substrate along the fixed suction table 1, d. controlling the fixed suction table 1 and tensioning the substrate driven on the fixed suction table through the printing station 18, e. opening of the opening/closing system of the front gripping means 2 when the position of the latter is in an area near the exit store 12 of the printing machine, f. return of the gripping means 2 in a storage area near the entry store 10.

It is understood from these embodiments that the clamps 2 successively grip the substrate as it enters the transport path. In some embodiments, the clamps 2 can be positioned previously relative to each other as a function of the respective positions in which they must grip the substrate (according to the configuration controlled by the computer facilities for example).

In some embodiments, the transversal distance between two guide means located on either side of the longitudinal axis of the transport path is variable. The method could therefore comprise at least one step for adjusting this distance between the guide means, for example as a function of the sizes of substrates located on the transport path.

In some embodiments, the method comprises a step for transversal tensioning of the substrate, performed by transversal tension means comprised in the gripping means and controlled by the computer facilities 14. This step is generally performed during or following closing of the gripping means 2.

As already mentioned in the present application, the invention enables longitudinal tensioning of the substrates, and advantageously irrespective of their sizes. In some embodiments of the method, the step of tensioning the substrate by the combined action of the suction table 1 and the gripping means 2 (preferably only the front gripping means) is carried out by the computer facilities 14 by controlling the speed of the gripping means 2 and the suction of the suction table 1; this control may of course depend on the physical characteristics of the substrate.

It is thus possible and advantageous to have only one front clamp per substrate or only one pair of front clamps per substrate according to a preferred embodiment of the present invention. However, this does not exclude the possibility of also having at least one rear clamp, although this is not necessary in accordance with the present invention; this also does not preclude the possibility of also having an inserted clamp (or pair of clamps), even if this is not necessary according to the present invention.

Figure 2:
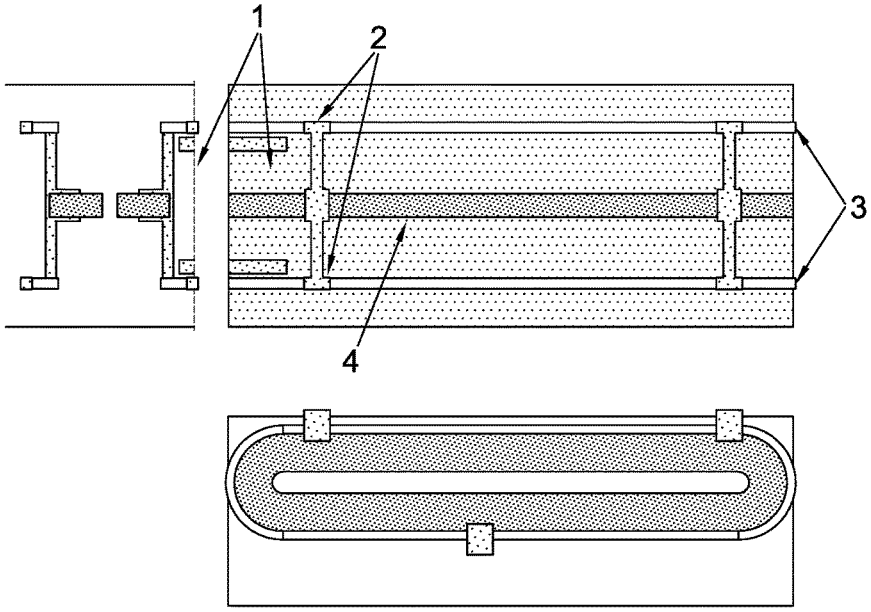

FIGS. 1 and 2 schematically illustrates a first embodiment of the invention, namely a mode using clamps 2 as gripping means. FIG. 1 shows two front clamps 2 on which the substrate is tapped; the substrate is moved on the suction table 1 located in the centre of the figure. FIG. 2 illustrates three different views of the printing module according to an embodiment in accordance with that of FIG. 1. FIG. 2 shows the suction table (1), the two front clamps (2), the guides (3) of the mobile gripping means and the linear motor (4).

Figure 3:
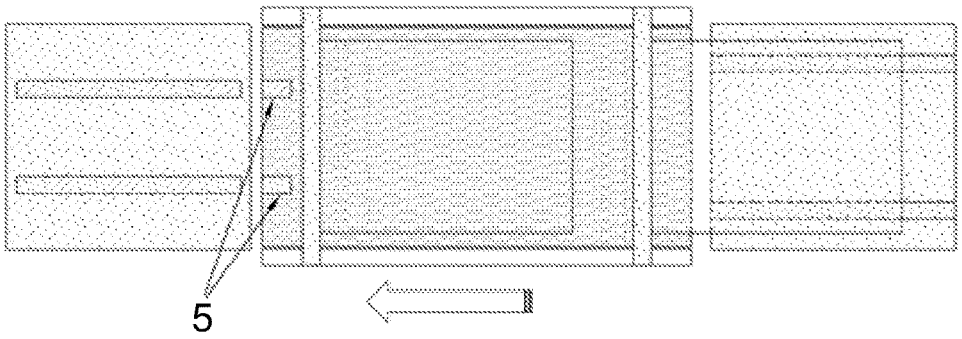
FIGS. 3 to 5 schematically illustrate other embodiments of the invention.
Figure 4:
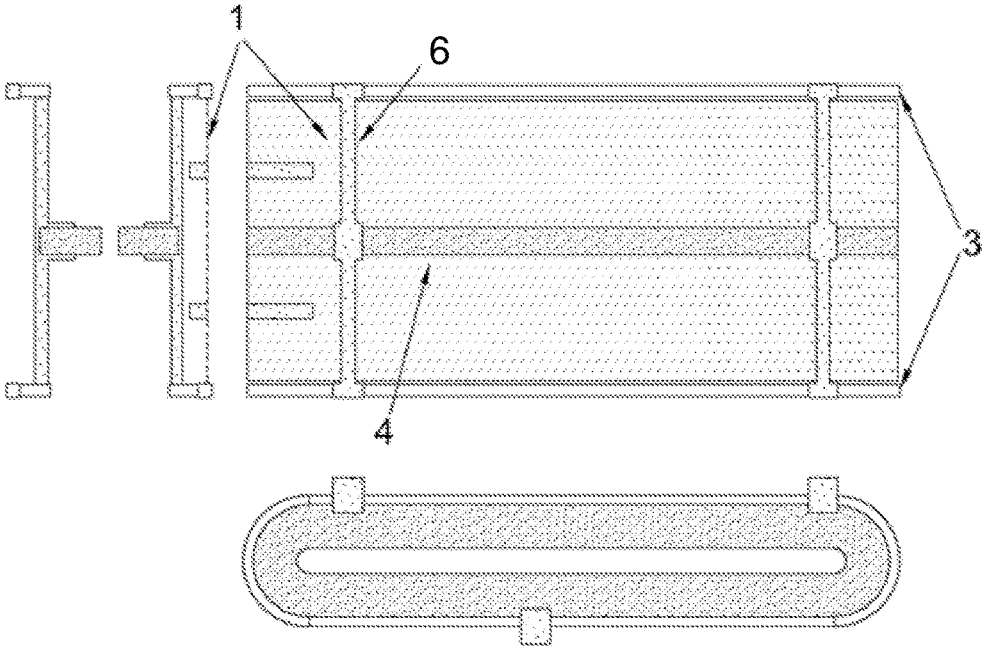
Figure 5:
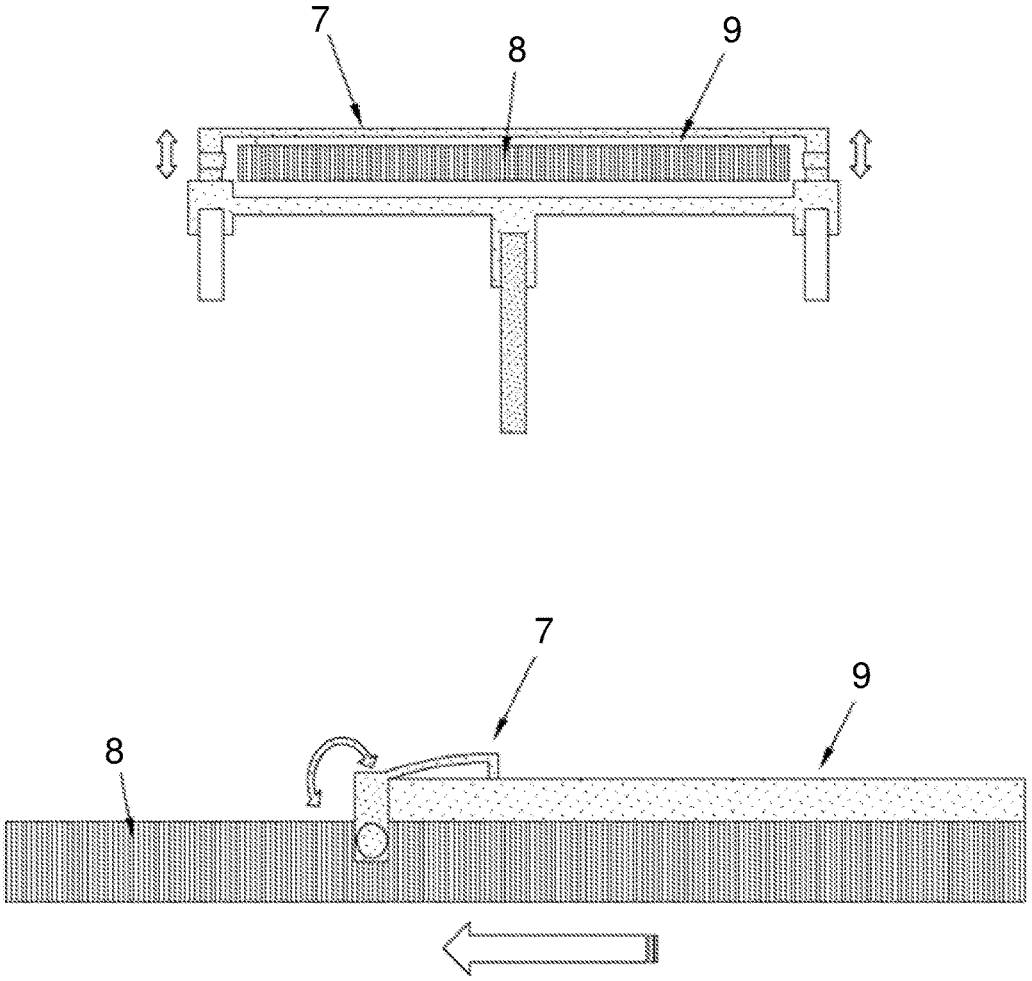

FIGS. 3 to 5 illustrate schematically other embodiments of the invention. FIG. 3 shows an embodiment in which the gripping means acts by pinching; the substrate is moved to the suction table located in the centre of the figure; belts or ejection rollers (5) can also be seen. FIG. 4 illustrates three different views of the printing module according to an embodiment in accordance with that of FIG. 3. FIG. 4 shows the suction table (1), the pinch bar (6), the guides (3) of the mobile gripping means and the linear motor (4). FIG. 5 illustrates the operation principle of the pinch bar: the pinch bar (7), suction table (8) and substrate (9) can be seen. The relative height between the pinch bar and the suction table is adjustable so as to adapt to different thicknesses and hardness of substrates. Upon insertion of the substrate, this pinch bar is first in the open position and the substrate comes to abut and align against this bar, the bar is then closed on the substrate and clamp the top substrate against the table with a force substantially greater than the friction force generated by the suction table on the substrate.

The present application describes various technical characteristics and advantages in reference to the figures and/or various embodiments. The man skilled in the art will understand that the technical characteristics of a given embodiment can in fact be combined with characteristics of another embodiment unless specified otherwise or it is evident that these characteristics are incompatible. Also, the technical characteristics described in a given embodiment can be separated from the other characteristics of this mode unless specified otherwise.

It must be evident for experts that the present invention enables embodiments in many other specific forms without departing from the field of application of the invention as claimed. Consequently, the present embodiments must be considered by way of illustration, but can be modified within the field defined by the scope of the appended claims, and the invention must not be limited to the details given hereinabove.

What is claimed is:

1. Substrate transport system in a printing machine comprising a printing station, along a transport path from at least one entry store supplying printable substrates to at least one exit store receiving the substrates, comprising:

at least one substrate;

an entry store for storing the substrate, a fixed suction table under the printing station for maintaining the substrate flat on the fixed suction table, a mobile gripping means gripping a front part of the substrate along the transport path, a guide means for guiding the gripping means along the transport path, a motorization means ensuring moving of the gripping means along the guide means, an exit store for storing the printed substrate, whereby the substrate transport system moves the substrate relative to and in direct contact with the fixed suction table along the transport path as the fixed suction table maintains the substrate flat and characterized in that the transverse dimension of the fixed suction table is at least equivalent to the transverse dimension of the substrate.

2. Substrate transport system in a printing machine according to claim 1, characterized in that the fixed suction table comprises one longitudinal recess wherein the gripping means is housed.

3. Substrate transport system in a printing machine according to claim 1, characterized in that the printing machine comprises a station for curing and/or drying the ink located after the printing station.

4. Substrate transport system in a printing machine according to claim 3, characterized in that it comprises:

a fixed suction table located under the station for curing and/or drying the ink for maintaining the substrate flat on the fixed suction table, the transverse dimension of the fixed suction table being at least equivalent to the transverse dimension of the substrate, and a mobile gripping means for moving the printed substrate on the fixed suction table under the station for curing and/or drying after printing.

5. Substrate transport system in a printing machine according to claim 3 characterized in that the fixed suction table for maintaining the substrate flat and the mobile gripping means for moving the substrate under the printing station and under the drying and/or curing station are identical.

6. Substrate transport system in a printing machine according to claim 1, wherein the printing station comprises print heads and characterized in that the vertical dimensions of the mobile gripping means located above the substrate are less than 80% of the distance between the upper face of the substrate and the print heads of the printing station, and less than 4 mm.

7. Substrate transport system in a printing machine according to claim 6, wherein the vertical dimensions of the mobile gripping means located above the substrate are less than 2 mm.

8. Substrate transport system in a printing machine according to claim 1, characterized in that the mobile gripping means comprises a clamp for gripping the substrate, said clamp comprising a fixed part facing the front side of the substrate (the front side being the printable side of the substrate) and a mobile part facing the rear side of the substrate.

9. Substrate transport system in a printing machine according to claim 1, characterized in that the fixed suction table consists of, at least in its upper layer coming into contact with the substrate, a material allowing the substrate to slide on the fixed suction table.

10. Substrate transport system in a printing machine according to claim 9, wherein the material is a thermoplastic polymer and/or polytetrafluoroethylene.

11. Substrate transport system in a printing machine according to claim 1, characterized in that a surface of the fixed suction table induces a friction force generating tensioning of the substrate when moved.

12. Substrate transport system in a printing machine according to claim 1, characterized in that the fixed suction table comprises sensors and several suction zones that control the suction power of the fixed suction table as a function of the positioning of the substrate based on information regarding the position of the substrate from the sensors.

13. Substrate transport system in a printing machine according to claim 1, characterized in that the gripping means are transverse strips.

14. Substrate transport system in a printing machine according to claim 1, characterized in that it comprises only front gripping means as the gripping means and a single motorization means as the motorization means ensuring the displacement of the front gripping means.

15. Substrate transport system in a printing machine according to claim 1, characterized in that it comprises computer facilities for controlling one or more elements of the system, including the fixed suction table and/or the mobile gripping means and/or the printing station.

16. Substrate transport system in a printing machine according to claim 1, further comprising:

a transport system for the substrate from the entry store to the fixed suction table; and/or a transport system for the printed substrate from the fixed suction table to the exit store.

17. Method for transport of substrates in a transport system in a printing machine comprising a printing station along a transport path, from an entry store to an exit store, said transport system comprising a fixed suction table under the printing station, a mobile gripping means and a motorization means of the gripping means, characterized in that it comprises the following steps:

a) storing a printable substrate in the entry store, b) moving and maintaining the substrate flat on the fixed suction table as the substrate moves relative to and in direct contact with the fixed suction table along a transport path, wherein the transverse dimension of the fixed suction table is at least equivalent to the transverse dimension of the substrate, c) positioning of the gripping means by said motorization means in an area near the entry store, d) following detection, by detection means, of a front transversal edge of the substrate relative to the direction of moving, gripping by the gripping means of at least an edge of the substrate near the front part of said substrate, said gripping means dragging the substrate on the fixed suction table through the printing station, e) releasing by the gripping means when the position of the said substrate is in an area near the exit store of the printing machine, f) storing of the printed substrate in the exit store, and g) return of the gripping means in an area near the entry store.

18. Method for transport of substrates according to claim 17 characterized in that the tensile force exerted by the mobile gripping means to move the substrate is at least greater than the force for maintaining in position said substrate on the fixed suction table.

19. Use of a method for transport of printable substrates in a printing machine for transporting the substrate and inkjet printing, the inkjet printing being performed without contact with the substrate during its transport wherein the method for transport of printable substrates in a transport system in the printing machine comprising a printing station along a transport path, from an entry store to an exit store, the transport system comprising a fixed suction table under the printing station, a mobile gripping means and a motorization means of the gripping means, and wherein the method comprises the following steps:

storing the substrate in the entry store, moving and maintaining the substrate flat on the fixed suction table as the substrate moves relative to and in direct contact with the fixed suction table along a transport path, wherein the transverse dimension of the fixed suction table is at least equivalent to the transverse dimension of the substrate, positioning of the gripping means by said motorization means in an area near the entry store, following detection, by detection means, of a front transversal edge of the substrate relative to the direction of moving, gripping by the gripping means of at least an edge of the substrate near the front part of said substrate, said gripping means dragging the substrate on the fixed suction table through the printing station, releasing by the gripping means when the position of the said substrate is in an area near the exit store of the printing machine, storing of the printed substrate in the exit store, and return of the gripping means in an area near the entry store.

* * * * *